US007076931B1

(12) United States Patent
Trani et al.

(10) Patent No.: US 7,076,931 B1
(45) Date of Patent: Jul. 18, 2006

(54) METHOD FOR MANUFACTURING CONTAINER WITH INHERENTLY STABLE BASE

(75) Inventors: Giorgio Trani, Venice (IT); Marion Sterner, Venice (IT)

(73) Assignee: BP Europak S.p.A. (IL)

( * ) Notice: Subject to any disclaimer, the term of this patent is extended or adjusted under 35 U.S.C. 154(b) by 113 days.

(21) Appl. No.: 09/678,008

(22) Filed: Oct. 3, 2000

(30) Foreign Application Priority Data

Oct. 5, 1999 (IT) ..... PD99A0216

(51) Int. Cl.
*B65B 3/02* (2006.01)

(52) U.S. Cl. ..... 53/452; 53/451; 53/563; 53/574

(58) Field of Classification Search ..... 53/452, 53/451, 480, 476, 563, 574
See application file for complete search history.

(56) References Cited

U.S. PATENT DOCUMENTS 3,145,112 A 8/1964 Boegershausen
4,081,944 A * 4/1978 Sjostrand
4,747,253 A * 5/1988 Schulte ..... 53/451
4,891,929 A * 1/1990 Branchi ..... 53/451
5,551,206 A * 9/1996 Fukuda ..... 53/451
5,561,966 A * 10/1996 English ..... 53/451

FOREIGN PATENT DOCUMENTS

FR 2759981 * 8/1998
GB 1115636 * 5/1968
WO 98/18674 * 5/1998

* cited by examiner

*Primary Examiner*—Louis K. Huynh

*Assistant Examiner*—Sameh H. Tawfik

(74) *Attorney, Agent, or Firm*—Kudirka & Jobse LLP

(57) ABSTRACT

A container made of flexible material with an inherently stable base and a method for manufacturing the container, the container being obtained in the shape of a pouch which has, in the region that will form the base, heat-sealed lateral regions and optionally ribbed guides which, by virtue of the very weight of the material that is introduced or by way of a punch, produce a base which makes the final container inherently stable.

9 Claims, 4 Drawing Sheets

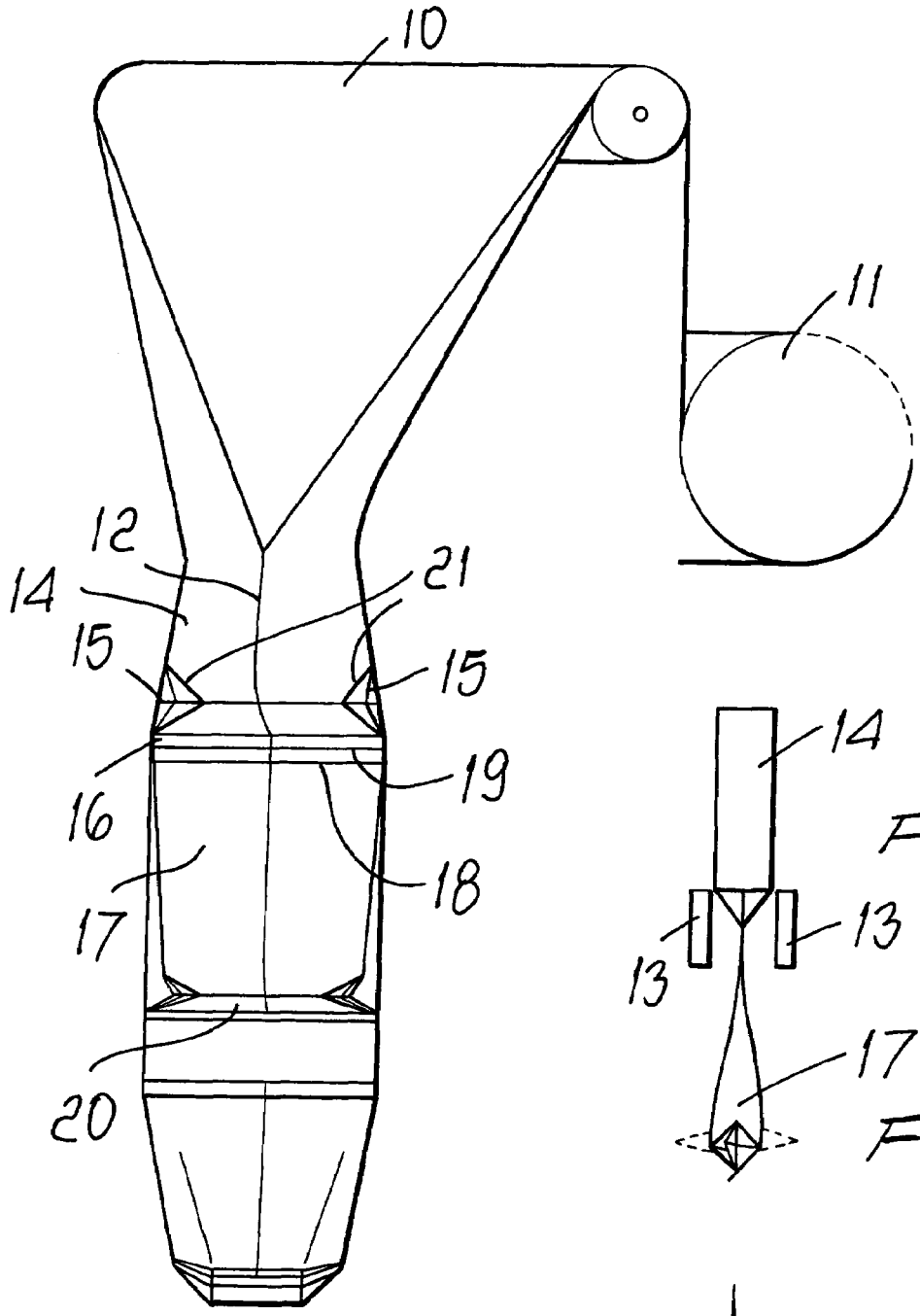
Fig. 1
Fig. 1a
Fig. 1b
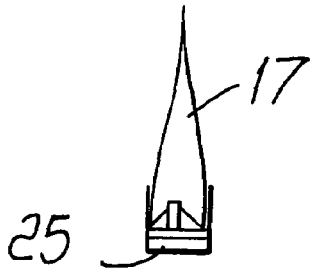
Fig. 1c

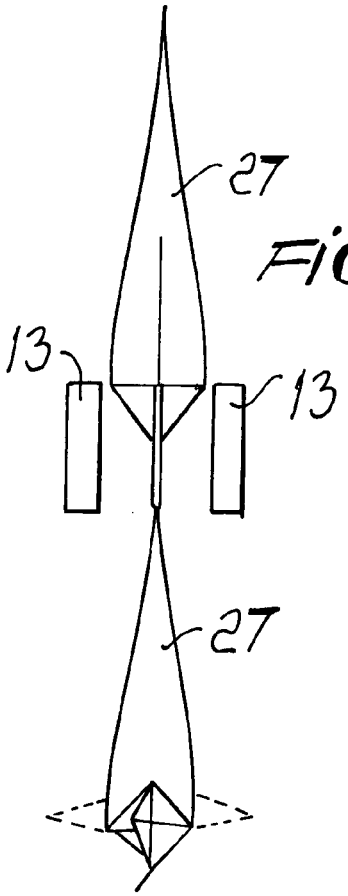
Fig. 2a
Fig. 2b
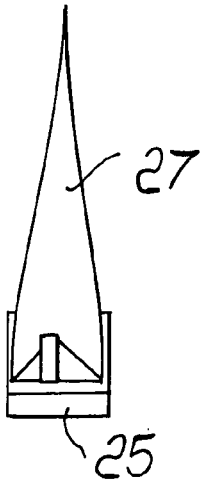
Fig. 2c
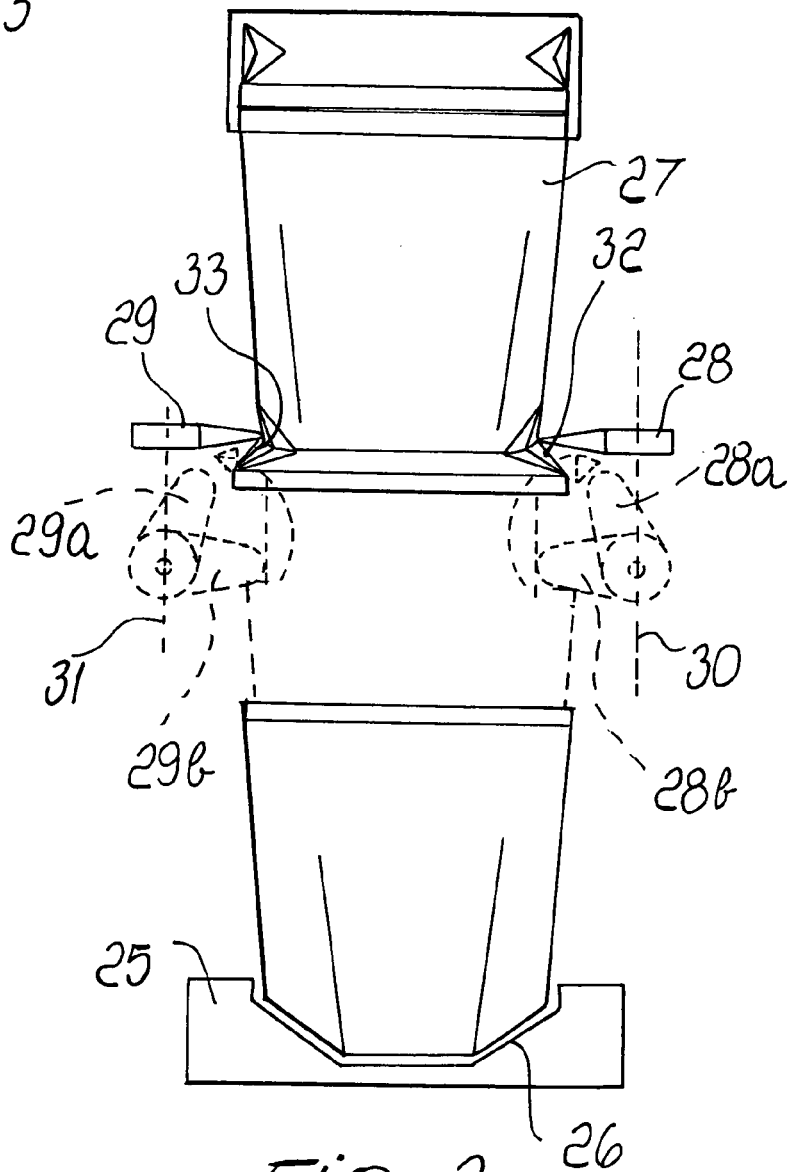
Fig. 2

METHOD FOR MANUFACTURING CONTAINER WITH INHERENTLY STABLE BASE

CROSS-REFERENCE TO RELATED APPLICATIONS

This application claims priority to Italian Application No. PD99A000216 filed Oct. 5, 1999, the disclosure of which is incorporated herein by reference.

BACKGROUND OF THE INVENTION

The present invention relates to a container with an inherently stable, self-shaping base which is made of flexible material and to a method for manufacturing it.

Pouch-like containers made of flexible material, formed with a lightweight sheet starting from a tubular structure, are known and widely used.

These pouches, manufactured according to the state of the art, are poorly suited for containing liquids, granular products or powders which do not have a definite geometry of their own, so that the resulting containers are not inherently stable and cannot all be arranged in the same manner in the packages for transport and storage and in the points of sale and display.

According to the state of the art, containers are also known which instead have a shape of their own but are obtained with rigid or semirigid materials or with complicated structural configurations having a shape of their own which must not be modifiable by the product introduced therein.

This type of container entails a more expensive manufacturing process, and the material from which it is obtained also is more expensive.

Moreover, these containers are convenient only if they are manufactured on the filling line itself, since any storage thereof when empty would be excessively wasteful in terms of space occupation.

SUMMARY OF THE INVENTION

The aim of the present invention is to provide a container to be manufactured using flexible material which assumes and maintains, after filling, a very specific shape of its own.

An object is to provide a container which after filling is inherently stable, i.e., forms a very specific resting base.

Another object is to provide a container which is pouch-shaped before filling and can therefore be stored in rolls.

Another object is to provide a method for manufacturing a container with an inherently stable base made of flexible material which allows fast and low-cost manufacture.

These and other objects which will become better apparent hereinafter are achieved by a container with an inherently stable base made of flexible material, characterized in that it is initially constituted by a pouch which is heat-sealed along a continuous longitudinal line and along evenly spaced transverse lines, said pouch having, in the region where the base will be formed, heat-sealed regions which are substantially shaped like a triangle whose base coincides with the edge of the pouch and whose vertex wedges inside said pouch, said regions, preferably with the aid of ribbed folding guides, automatically determining the shape of the container with a predefined base when said container is filled with a liquid or granular product or is opened by way of a punch.

The present invention also relates to a method for manufacturing an inherently stable container made of flexible material, characterized in that it comprises the following steps:

a) folding a continuous film of flexible material of appropriate width, obtaining a pouch by way of a longitudinal heat-seal and by means of evenly spaced transverse heat-seals, a first one of which is followed by cropping;

b) heat-sealing in the sides of the pouch, in the region of the transverse heat-seal, two triangles, each of which has a base which coincides with one of the two edges of the pouch and a vertex which wedges toward the inside of said pouch;

c) filling the pouch with the product to be contained, or entering the pouch with a punch to open it;

d) folding and bonding, with an adhesive means, the wings that form adjacent to the base simultaneously with the heat-sealing of the upper open mouth.

BRIEF DESCRIPTION OF THE DRAWINGS

Further characteristics and advantages of the invention will become better apparent from the detailed description of a preferred embodiment and of a method for performing it, which are given by way of non-limitative example and are illustrated in the accompanying drawings, wherein:

FIG. 1 is a schematic view of a line for manufacturing the container according to the invention;

FIGS. 1*a*, 1*b* and 1*c* are three schematic side views of what is shown in FIG. 1;

FIG. 2 is a view of alternative steps of the manufacture of the container according to the invention;

FIGS. 2*a*, 2*b* and 2*c* are three side views of what is shown in FIG. 2;

DESCRIPTION OF THE PREFERRED EMBODIMENTS

Figure 3:
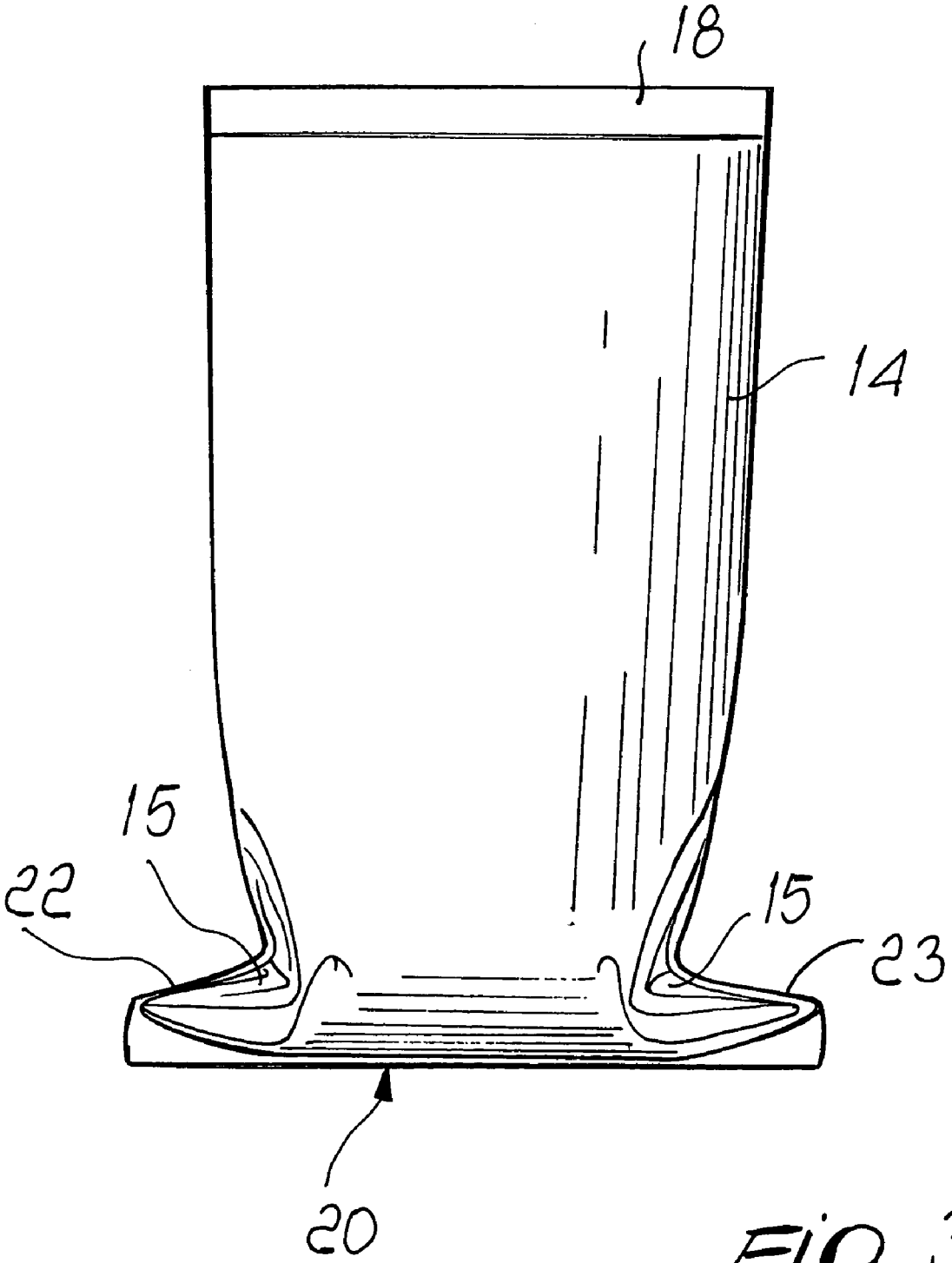
FIG. 3 is a view of the container before the lower wings are folded.

With reference to the figures, the container according to the invention is obtained starting from a sheet 10 made of heat-sealable plastic material which is unwound from a roll 11 and is heat-sealed along a longitudinal line 12 after folding said sheet.

In a subsequent step, shaped bars 13 kept at a temperature which allows the melting of the sheet 10 provide, in the region that will correspond to the base region of the container 14 being formed, lateral triangles 15 and a heat-sealed transverse region 16 which closes the base of the container.

Simultaneously with the heat-sealing of the base through the heat-sealed region 16, the upper mouth of the container 17 that has already been formed and filled, is closed by way of a transverse heat-seal 18, while separation of said container is achieved by means of a cropping operation 19 which separates the two containers in the heat-sealing regions.

Owing to the presence of the heat-sealed triangles 15, the weight of the introduced material determines the formation of a flat base 20 produced by the wedging of the heat-sealed triangles 15 with the optional aid of ribbed guides 21 which are formed in the same operation that forms the heat-sealed triangles 15.

As shown more clearly in FIG. 3, the container 14 filled with material, by forming the base 20, forms two protruding wings 22 and 23 indeed because of the presence of the heat-sealed triangles 15.

Figure 4:
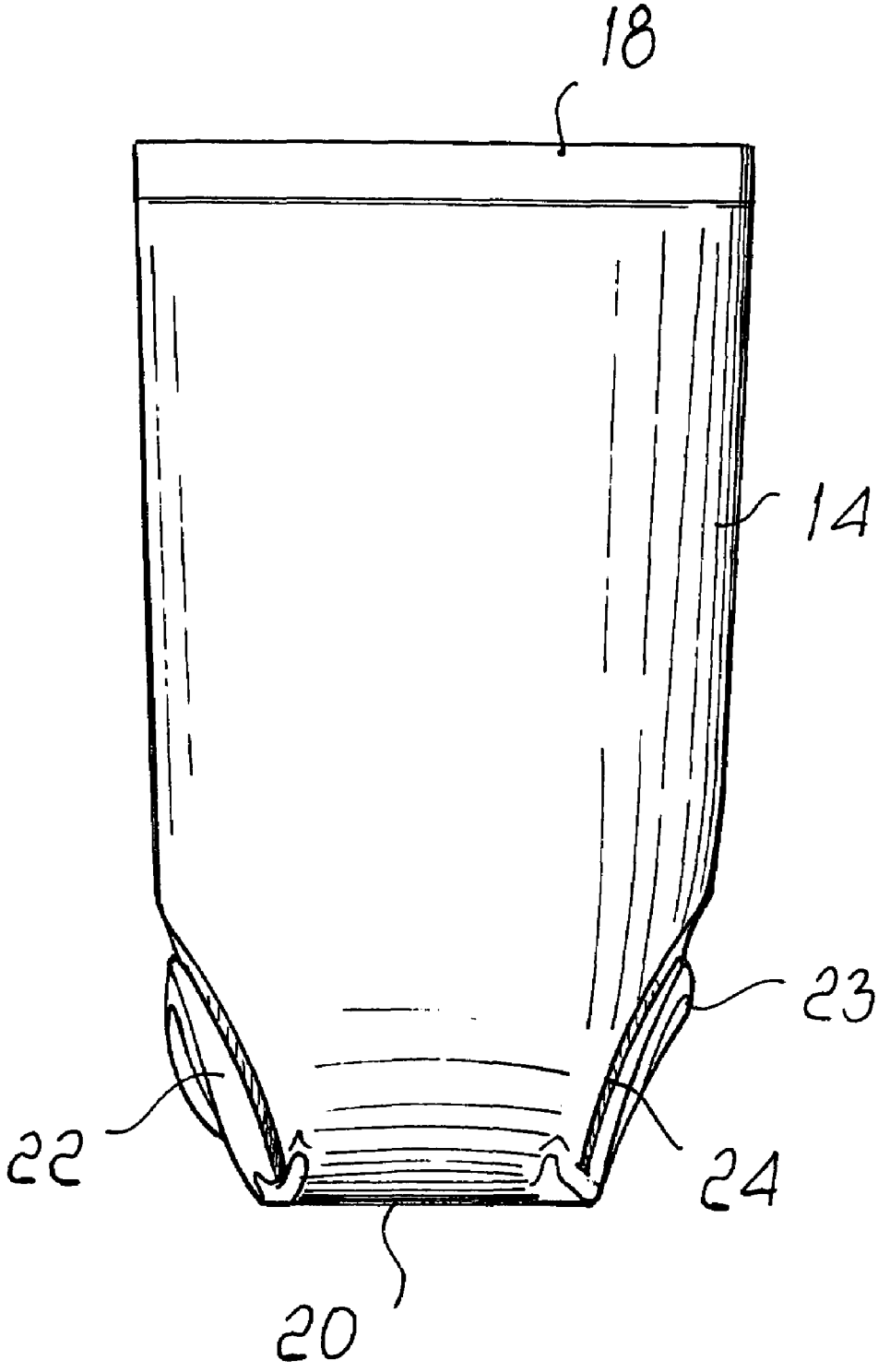
FIG. 4 is a view of the container with its wings folded and with its upper mouth heat-sealed.

These two wings, in a final operation, as shown in FIG. 4, are folded against the container and are retained by heat-sealing or by applying an adhesive means along the mating line 24.

In this manner, the container 14, besides having a flat base 20 which allows to position it safely, has no external bulk-forming elements and can be packaged together with many others without wasting space.

Folding and gluing of the wings 22 and 23 occurs, as shown in FIG. 2, with the aid of a shaped body 25 which has a heated seat 26 which duplicates the final shape of the base to be obtained, which forms due to the effect of the weight.

Said FIG. 2 illustrates an auxiliary system for inserting, in the space occupied by the container, now designated by the reference numeral 27, the heat-sealed triangles in order to form the flat base.

Said auxiliary means are constituted by insertion blades 28 and 29 which, by rotating about two axes 30 and 31 which are parallel to the advancement line of the container, push the triangles, now designated by the reference numerals 32 and 33, inside the container 27.

In FIG. 2, dashed lines show the two blades 28 and 29 also in a plan view, in which they are illustrated in two positions: an outer one, designated by the reference numerals 28*a* and 29*a*, and an inner one, designated by the reference numerals 28*b* and 29*b*, which illustrate the insertion of the triangles.

The resulting container is highly advantageous, since by being formed from a flexible sheet it has all the characteristics and advantages of this type of container related to the manufacturing processes and to the printing thereon of designs and lettering.

Moreover, manufacturing can be of the continuous type, and this is very advantageous because it is inexpensive and uses thoroughly tested forming and filling machines.

Furthermore, the containers can be prepared empty and kept flat for storage until they are filled; during filling they assume their final shape by forming the flat base.

It clearly appears that the intended aim and objects have been achieved together with the corresponding advantages.

It is of course possible to use, as source materials, several known types of heat-sealable flexible material.

The dimensions of the container may be any according to requirements.

The disclosures in Italian Patent Application No. PD99A000216 from which this application claims priority are incorporated herein by reference.

What is claimed is:

1. A method for manufacturing an inherently stable container made of flexible material, comprising the following steps:

a) folding a continuous film of flexible material of appropriate width, to obtain a pouch having a longitudinal heat-seal and evenly spaced transverse heat-seals, followed by cropping the folded film in a direction transverse to the longitudinal heat seal;

b) heat-sealing in sides of the pouch, at a region of the transverse heat-seals, forming two triangles having wings laterally disposed relative to the longitudinal heat-seal;

c) punch opening said pouch, and optionally filling the pouch with a product;

d) folding and bonding the wings laterally relative to the longitudinal heat-seal and, after filling the pouch, simultaneously with the bonding off the wings, heat-sealing an upper open mouth of the pouch.

2. The method of claim 1, wherein in the first step the film is folded so as to form the pouch, which is closed longitudinal by heat-sealing overlapping flaps of said film, said heat-sealing being preferably located at a center of one of two flat faces of said pouch.

3. The method of claim 2, wherein the heat-sealing of the triangles comprises heat-sealing of two overlapping sheets of flexible material that constitute said pouch so as to form at the base, said two triangles with vertex wedging inside said pouch.

4. The method of claim 1, wherein a longitudinal dimension of the pouch is determined by way of transverse heat-seals.

5. The method of claim 1, further comprising forming ribs during the step for forming the heat-sealed triangles, said ribs being adapted to facilitate, by guided deformation, opening of the pouch at filling.

6. The method of claim 5, wherein during filling of the pouch with product a substantially flat base forms, while said wings formed due to the heat-sealed triangles protrude laterally beyond said base.

7. The method of claim 6, wherein following said filling step said wings are folded toward the container and are retained thereon.

8. The method of claim 1, comprising insertion of the heat-sealed triangles inside the container by way of pushing means which push said triangles from the outside inward.

9. A method for manufacturing an inherently stable container made of flexible material, comprising the steps of:

a) folding a continuous film of flexible material of appropriate width, to obtain a pouch having a longitudinal heat-seal and evenly spaced transverse heat-seals, followed by cropping the folded film in a direction transverse of the longitudinal heat-seal;

b) heat-sealing two triangles having wings into sides of the pouch lateral to the longitudinal heat-seal, each of the triangles having a base which coincides with one edge of the pouch and a vertex which wedges inwards said pouch lateral to the longitudinal heat-seal punch opening said pouch, and optionally filling the pouch with a product folding and bonding the wings onto the triangles.

* * * * *

UNITED STATES PATENT AND TRADEMARK OFFICE

CERTIFICATE OF CORRECTION

PATENT NO. : 7,076,931 B1
APPLICATION NO. : 09/678008
DATED : July 18, 2006
INVENTOR(S) : Trani et al.

It is certified that error appears in the above-identified patent and that said Letters Patent is hereby corrected as shown below:

On the title page item (73), BP Europak S.p.A. should be changed to BP Europack S.p.A.

Signed and Sealed this

Seventh Day of November, 2006

JON W. DUDAS
*Director of the United States Patent and Trademark Office*